US010980319B1

(12) United States Patent
Tahinos

(10) Patent No.: US 10,980,319 B1
(45) Date of Patent: Apr. 20, 2021

(54) REVERSIBLE BELT BUCKLE

(71) Applicant: Randa Accessories Leather Goods, LLC, New York, NY (US)

(72) Inventor: Christopher Tahinos, New York, NY (US)

(73) Assignee: Randa Accessories Leather Goods, LLC, New York, NY (US)

( * ) Notice: Subject to any disclaimer, the term of this patent is extended or adjusted under 35 U.S.C. 154(b) by 231 days.

(21) Appl. No.: 16/362,006

(22) Filed: Mar. 22, 2019

(51) Int. Cl.
*A44B 11/00* (2006.01)
*A44B 11/22* (2006.01)
*A41F 9/00* (2006.01)

(52) U.S. Cl.
CPC ..... *A44B 11/006* (2013.01); *A41F 9/002* (2013.01); *A44B 11/223* (2013.01)

(58) Field of Classification Search
CPC ... A44B 11/006; A44B 11/223; A44B 11/001; A44B 11/20; A44B 11/226; A41F 9/002
USPC ..... 2/338
See application file for complete search history.

(56) References Cited

U.S. PATENT DOCUMENTS 91,390 A * 6/1869 Welker ..... A44B 11/223 24/180
1,511,665 A * 10/1924 Faulkner ..... A44B 11/223 24/180
2,078,651 A * 4/1937 Crocker, Jr. ..... A44B 11/223 24/180
2,186,819 A 8/1938 Buchsbaum
2,197,665 A 9/1938 Kemgood
3,274,617 A * 9/1966 Krantz ..... A44B 11/24 2/301
3,855,637 A 12/1974 Luger
4,052,773 A * 10/1977 Nesbitt ..... A44B 11/001 24/163 K
4,281,440 A 8/1981 Britz
4,406,043 A * 9/1983 Friedman ..... A44B 11/006 24/171
4,419,792 A * 12/1983 Kohli ..... A44B 11/24 24/170
4,477,949 A * 10/1984 Calabro ..... A44B 11/223 24/180
4,584,743 A 4/1986 Calabro
(Continued)

OTHER PUBLICATIONS

Photograph of Vintage Belt Buckle, prior to 2018.

*Primary Examiner* — Alissa L Hoey
(74) *Attorney, Agent, or Firm* — Kaplan Breyer Schwarz, LLP

(57) ABSTRACT

A belt having a strap and a reversible belt buckle is provided where the strap has a top surface and a rear surface. The buckle includes an inner frame member having a first end having a slot to receive the first end of the strap and a second end having a first hinge section. The buckle further includes a top member having a rear surface having second hinge section disposed at a central axis. The top member has a pin disposed on the second hinge section. The top member is rotatable about a hinge point from a first position wherein the rear surface of the top member at the first edge faces the front side of the inner frame member, to a second position wherein the rear surface of the top member at the second edge faces the rear side of the inner frame member. The top member substantially covers the entire inner frame member when in use.

2 Claims, 7 Drawing Sheets

(56) References Cited

U.S. PATENT DOCUMENTS

| | | | | |
|---|---|---|---|---|
| 4,996,751 | A * | 3/1991 | Keum | A44B 11/008 24/180 |
| 7,082,622 | B1 * | 8/2006 | Olander | A41F 9/002 2/336 |
| 7,143,483 | B1 * | 12/2006 | Potzman | A44B 11/001 24/185 |
| 7,480,967 | B2 * | 1/2009 | Kojoori | A44B 11/006 2/322 |
| 8,056,780 | B1 * | 11/2011 | Bruns | A44B 11/005 224/163 |
| 8,302,266 | B2 * | 11/2012 | Chen | A44B 11/001 24/163 K |
| 9,113,677 | B2 * | 8/2015 | Anderson | A44B 11/22 |
| 9,930,936 | B2 * | 4/2018 | Liu | A44B 11/006 |
| D885,972 | S * | 6/2020 | Tahinos | D11/216 |
| 10,856,625 | B1 * | 12/2020 | Weng | A44B 11/006 |
| 2004/0195281 | A1 * | 10/2004 | Hung | G04B 37/12 224/163 |
| 2014/0215766 | A1 * | 8/2014 | Liu | A44B 11/006 24/188 |
| 2016/0227859 | A1 * | 8/2016 | Burri | A41F 9/002 |
| 2019/0159554 | A1 * | 5/2019 | Mouquet | A44B 11/22 |
| 2019/0261746 | A1 * | 8/2019 | Shabot | A41F 9/002 |
| 2019/0387843 | A1 * | 12/2019 | Wang | A44B 11/006 |

* cited by examiner

REVERSIBLE BELT BUCKLE

BACKGROUND OF THE INVENTION

The present invention is directed to belt buckles. More particularly, the present invention is directed to a reversible belt strap and buckle construction, wherein the belt strap has two sides where each side has a different appearance or character. The buckle provides for use of either side of the belt strap and hides its mechanism for switching sides of the belt strap.

Reversible belts have long been known, where the belt may be worn such that either side of the belt strap may be made visible. A typical construction is where the belt strap is removably connectable to the buckle; to reverse the belt, the belt strap is detached from the belt buckle, turned one hundred eighty degrees, and reattached to the buckle. An alternative construction is where the buckle remains attached to the belt strap, but a mechanism on the belt buckle allows for rotation of the strap such that one side of the strap or the other is visible when worn. This second type of construction is relatively complex and costly.

It would be desirable to provide a belt where its belt buckle provides for easy reversibility of its belt strap, without detachment of the belt strap from the buckle.

It would further be desirable to provide a belt that is quickly and easily reversible with a simple buckle mechanism.

It would further be desirable to provide such a belt that is quickly and easily reversible with a simple buckle mechanism, wherein the buckle mechanism is entirely hidden when worn by a user.

Numerous designs in the prior art have been directed to reversible belts, however, none known has had the combination of extremely simple construction, where the buckle latching and reversing mechanism is entirely hidden during normal use. Some of such designs include the following:

U.S. Pat. No. 4,281,440 (Britz) is directed to a reversible belt having a buckle where the belt strap is removably connectable to the buckle. To reverse the belt, the belt strap is detached from the belt buckle, turned one hundred eighty degrees, and reattached to the buckle.

U.S. Pat. No. 4,584,743 (Calabro) is also directed to a reversible belt having a buckle where the belt strap is removably connectable to the buckle. To reverse the belt, the belt strap is detached from the belt buckle, turned one hundred eighty degrees, and reattached to the buckle.

U.S. Pat. No. 3,855,637 (Luger) is directed to a belt reversing mechanism that includes two clamping sections rotatably connected to each other by a rivet or an eyelet. One clamping section is connected to a belt buckle and the other is connected to a belt strap so that the belt strap may be rotated with respect to the belt buckle.

U.S. Pat. No. 2,186,819 (Buchsbaum) is directed to a reversible belt buckle in which a symmetric buckle has a belt strap attachment point at its center. Since the buckle is symmetric, its belt strap attachment point serves as an axis point to allow the buckle to operate with either side of the belt strap facing out.

U.S. Pat. No. 2,197,665 (Kerngood) is directed to a reversible belt buckle of a similar construction to that of U.S. Pat. No. 2,186,819 (Buchsbaum) discussed above.

All references cited herein are incorporated herein by reference in their entireties.

BRIEF SUMMARY OF THE INVENTION

A belt having a strap and a reversible belt buckle is provided. The strap has a first end and a second end where the second end has a plurality of holes. The strap further has a top surface and a back surface.

The buckle includes an inner frame member having a first end and a second end, a front side and a rear side. The first end has a slot to receive the first end of the strap. The second end has a first hinge section. The buckle further includes a top member having a front surface, a rear surface, a first edge, a second edge, and a central axis. The rear surface has second hinge section disposed at the central axis. The top member has a pin disposed on the second hinge section perpendicular to a plane of the top member at the central axis. The first hinge section mates with the second hinge section to form a hinge point such that the top member is rotatable about the hinge point from a first position wherein the rear surface of the top member at the first edge faces the front side of the inner frame member, to a second position wherein the rear surface of the top member at the second edge faces the rear side of the inner frame member. The top member substantially covers the entire inner frame member when viewing the front surface of the top member when the top member is in the first position or the second position. When the top member is in the first position, the front surface of the strap is exposed. When the top member is in the second position, the back surface of the strap is exposed.

A keeper may be disposed on the inner frame member of the buckle to secure the strap against the buckle. The keeper forms an aperture for receipt of the strap, wherein the keeper is slidable from a first position wherein, when the top member is in the first position, the aperture is disposed on the rear side of the inner frame member, and when the top member is in the second position, the aperture is disposed on the front side of the inner frame member. When the top member is in the first position, the rear surface of the top member may urge the keeper to its first position, and when the top member is in the second position, the rear surface of the top member may urge the keeper to its second position.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

Figure 1:
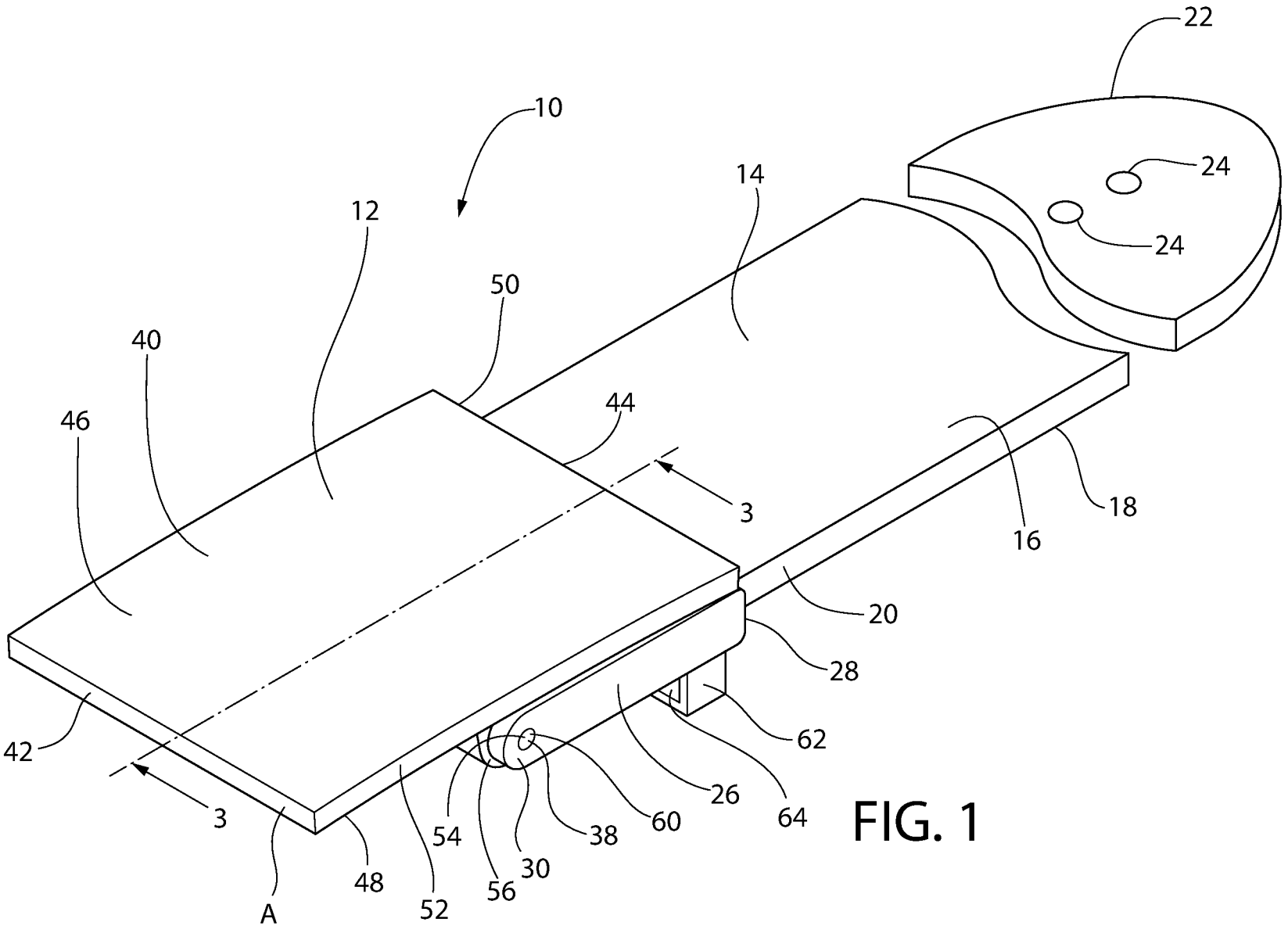
FIG. 1 is a front isometric view of a belt having a strap and a reversible buckle in accordance with an exemplary embodiment of the present invention.
Figure 2:
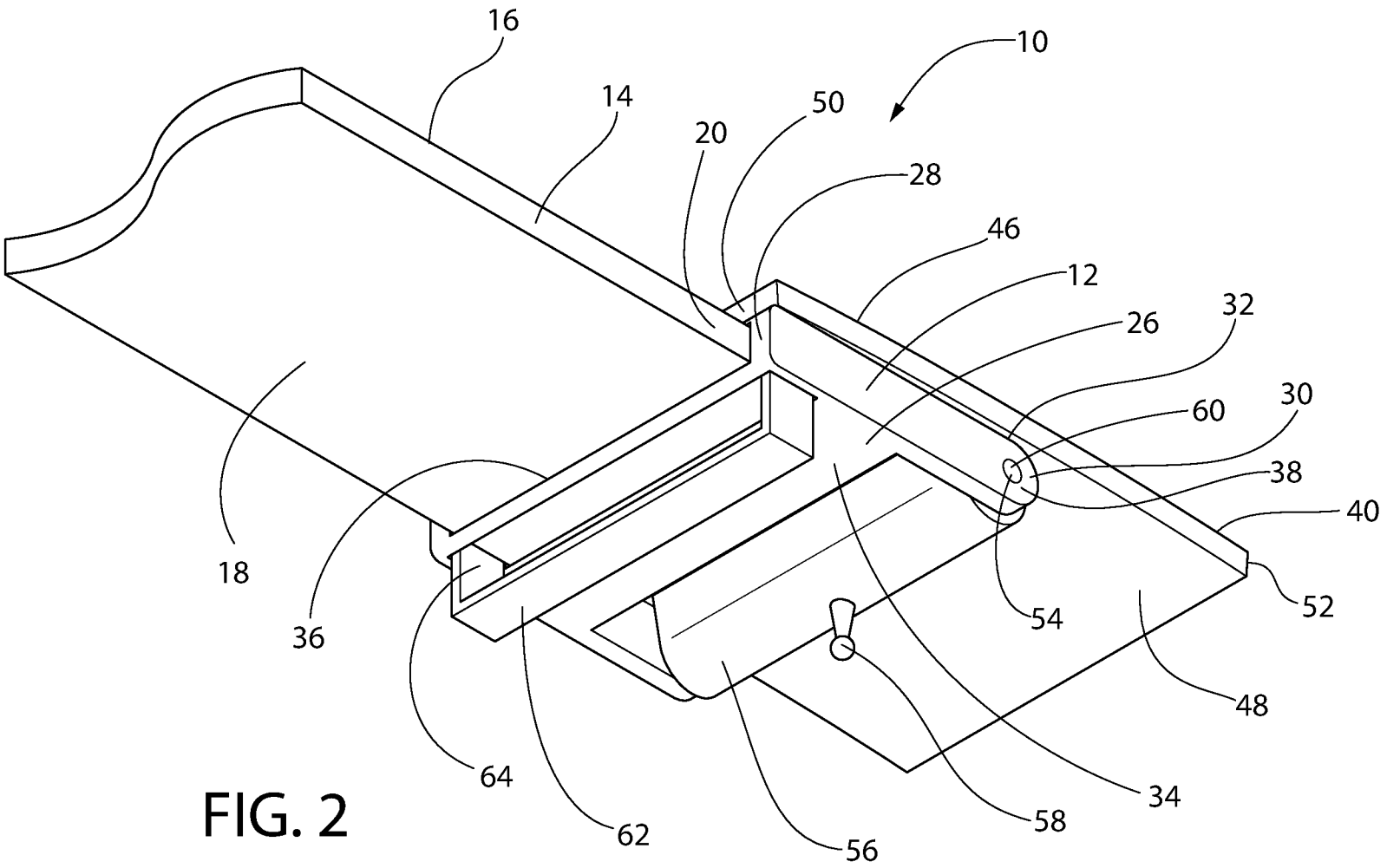
FIG. 2 is a rear isometric view of the belt having a strap and a reversible buckle of FIG. 1.
Figure 3:
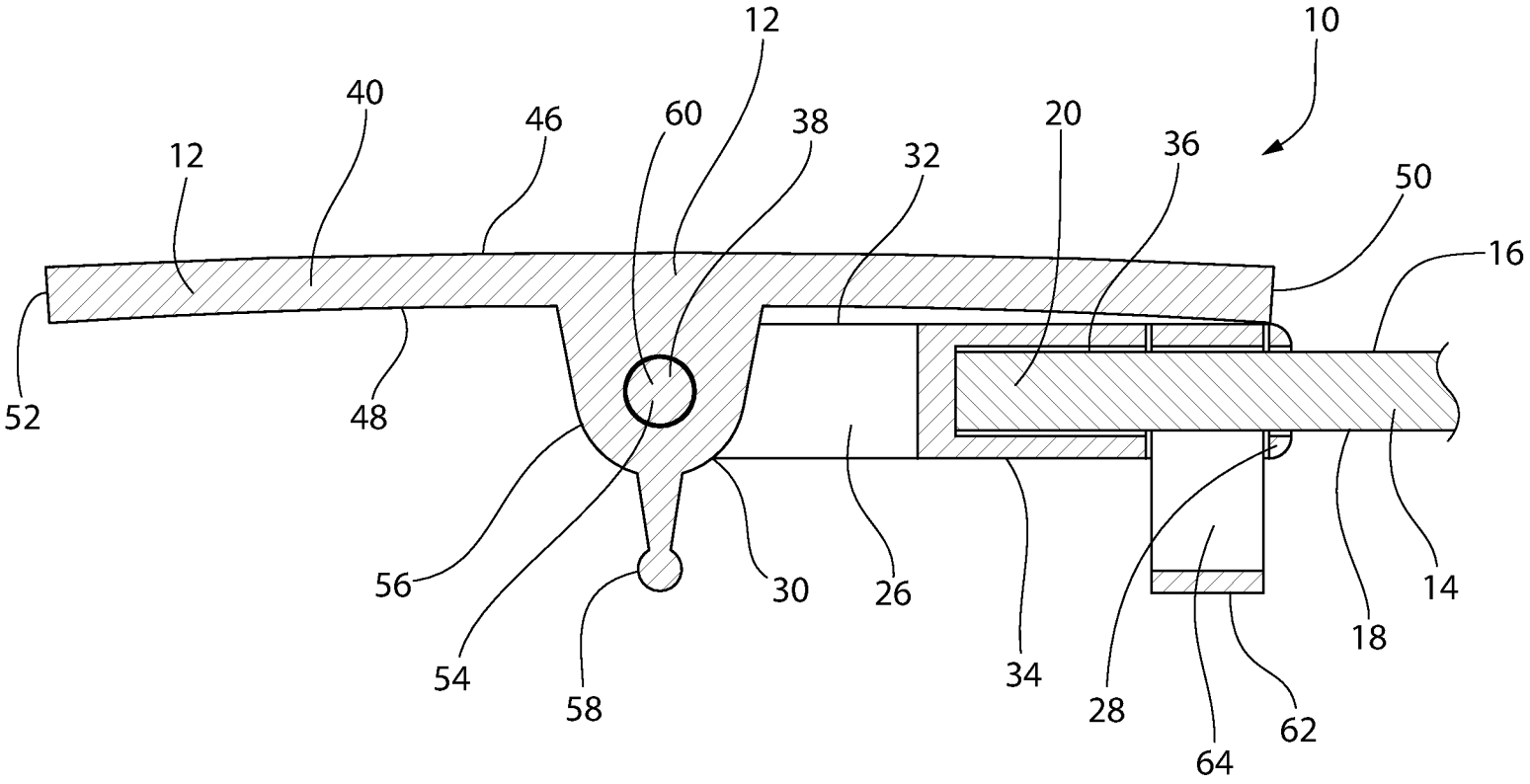
FIG. 3 is a cross-sectional view of the belt having a strap and a reversible buckle of FIG. 1, taken along lines 3-3 of FIG. 1, shown in a first condition where a first side of the strap is facing out.

The invention will be illustrated in more detail with reference to the following embodiment, but it should be understood that the present invention is not deemed to be limited thereto.

Referring now to the drawing figures wherein like part numbers refer to like elements throughout the several views, there is shown in FIGS. 1-7 a belt 10 having a reversible belt buckle 12 and a two-sided strap 14 in accordance with a first exemplary embodiment of the present invention. The strap 14 has a front surface 16 and a back surface 18 each preferably of a different color or character (for example black and brown, textured and smooth, etc.). The strap 14 has a first end 20 and a second end 22, where the second end 22 has a plurality of holes 24.

The buckle 12 includes an inner frame member 26 having a first end 28, a second end 30, a front side 32 and a rear side 34. The first end 28 has slot 36 to receive the first end 20 of the strap 14. The second end 30 of the inner frame member 26 has a first hinge section 38. The first end of the strap 14 is secured in the slot 36 by, for example, a set screw or screws or any other means known in the art of belts (not shown).

The buckle 12 also includes a top member 40 having a front surface 46, a rear surface 48, a first edge 50, a second edge 52, and a central axis 54. The rear surface 48 has second hinge section 56 disposed at the central axis 54. The top member 40 has a pin 58 disposed on the second hinge section 56 perpendicular to a plane A of the top member 40 at the central axis 54. The pin 58 is adapted to be received in any one of the plurality of holes 24 of the strap 14. It is noted that the term "plane" is not intended to always mean a perfectly flat surface. The top member 40 may be slightly curved (for example, as shown in FIGS. 3-6. The term "plane" is therefore meant to be an approximation of a completely flat plane.

Figure 4:
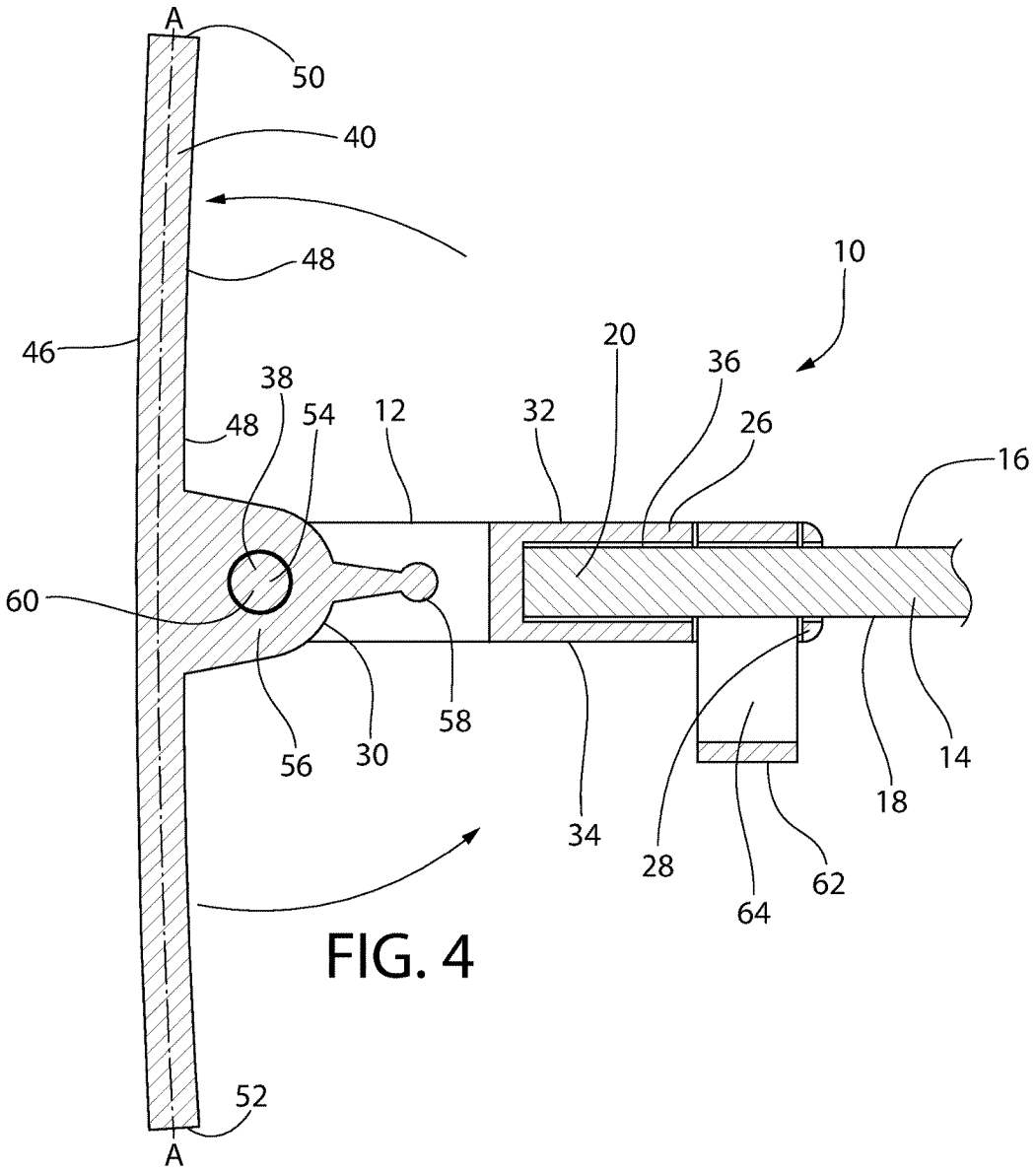
FIG. 4 is a cross-sectional view of the belt having a strap and a reversible buckle of FIG. 1, taken along lines 3-3 of FIG. 1, shown in a mid-point condition, as the buckle is being configured to have be in one of the first condition, or a second condition, where a second side of the strap is facing out.
Figure 5:
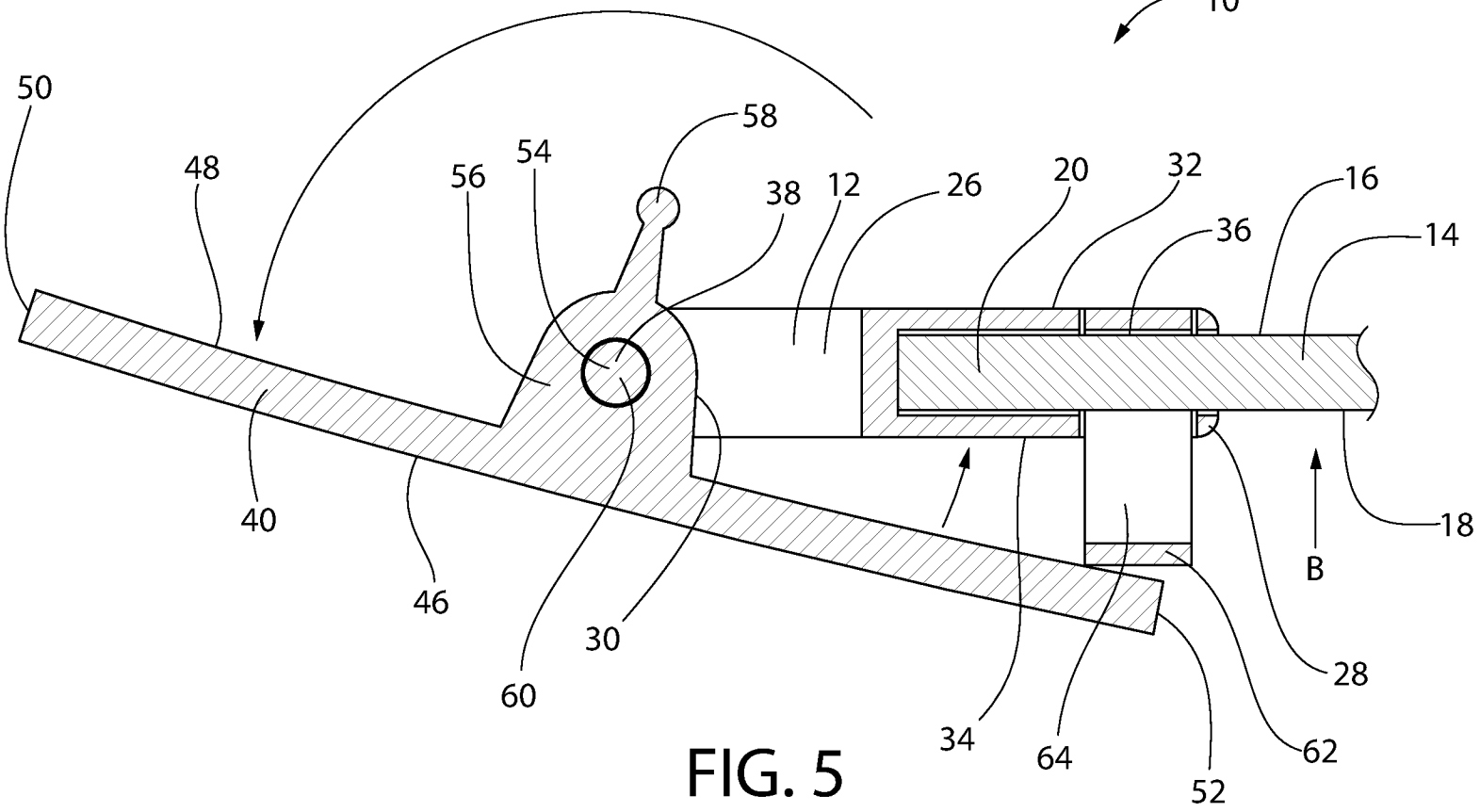
FIG. 5 is a cross-sectional view of the belt having a strap and a reversible buckle of FIG. 1, taken along lines 3-3 of FIG. 1, shown in a condition, as the buckle is being configured just prior to where the second side of the strap is facing out.
Figure 6:
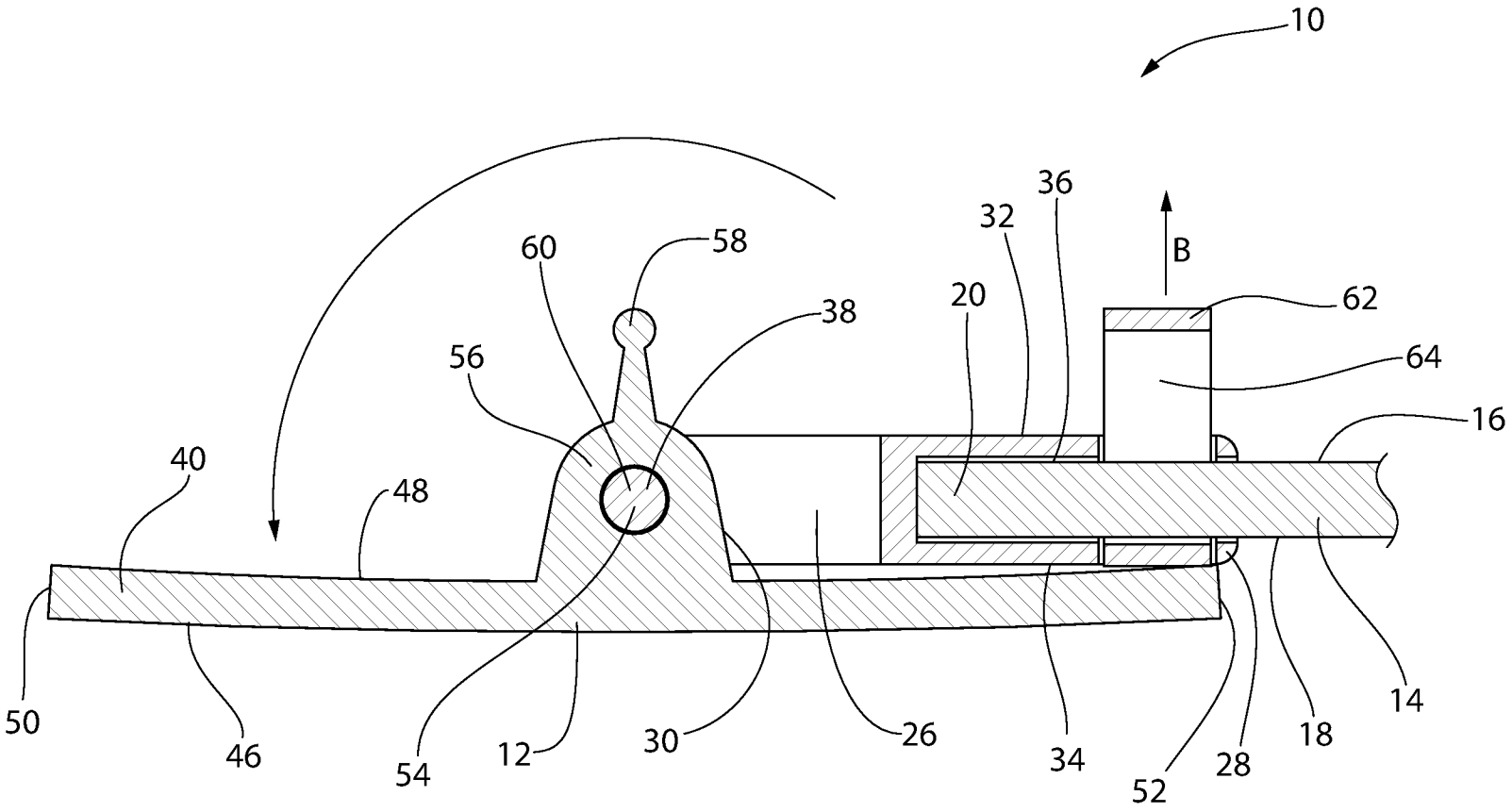
FIG. 6 is a cross-sectional view of the belt having a strap and a reversible buckle of FIG. 1, taken along lines 3-3 of FIG. 1, shown in a second condition where the second side of the strap is facing out.

The first hinge section 38 mates with the second hinge section 56 to form a hinge point 60, wherein the top member 40 is rotatable about the hinge point 60 from a first position (see FIG. 3) wherein the rear surface 48 of the top member 40 at the first edge 50 faces the front side 32 of the inner frame member 26, to a second position (see FIG. 6) wherein the rear surface 48 of the top member 40 at the second edge 52 faces the rear side 34 of the inner frame member 26. FIGS. 4 and 5 depict the buckle 12 rotating from the first position of FIG. 3 to the second position of FIG. 6.

When the top member 40 is in the first position (see FIG. 3), the front surface 16 of the strap 14 is exposed. When the top member 40 is in the second position (see FIG. 6), the back surface 18 of the strap 14 is exposed.

Figure 7:
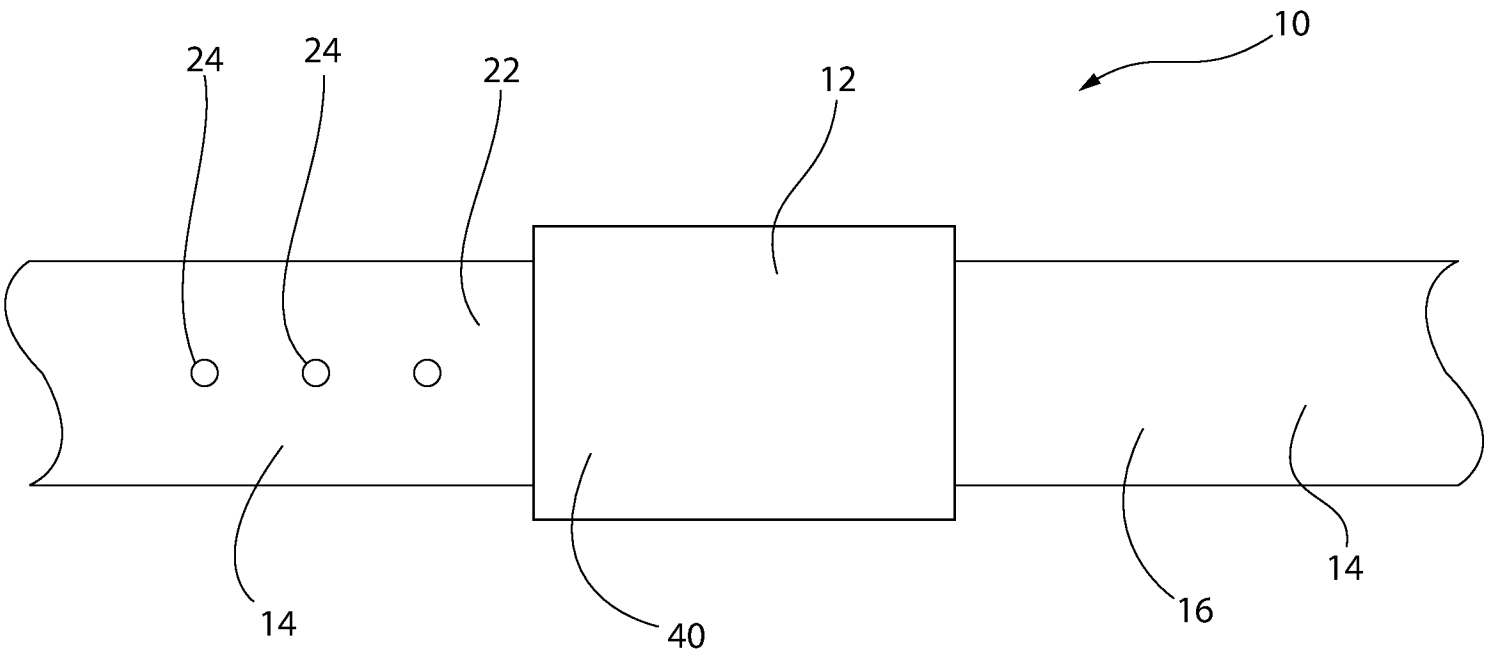
FIG. 7 is a front, elevation view of the belt having a strap and reversible buckle of FIG. 1, showing the belt in a buckled configuration.

Importantly, as shown in FIG. 7, the top member 40 substantially covers the entire inner frame member 26 when viewing the front surface 46 of the top member 40 when the buckle and strap are mated together in a buckled configuration during use. That is, during normal use by a user of the belt 10 of the present invention, the inner frame member 25 cannot be seen by casual observers of a person wearing the belt 10.

A keeper 62 may be disposed on the inner frame member 26 of the buckle 12 to secure the strap 14 against the buckle 12. The keeper 62 forms an aperture 64 for receipt of the second end 22 of the strap 14, wherein the keeper 62 is slidable in direction B from a first position (see FIG. 5) wherein, when the top member 40 is in the first position (see FIG. 3), the aperture 64 is disposed on the rear side 34 of the inner frame member 26, and when the top member 40 is in the second position (see FIG. 6), the aperture 64 is disposed on the front side 32 of the inner frame member 26. When the top member 40 is in the first position (see FIG. 3), the rear surface 48 of the top member 40 urges the keeper 62 to its first position (see FIGS. 3 and 5). When the top member 40 is in the second position, the rear surface 48 of the top member 40 urges the keeper 62 to its second position (see FIG. 6).

While the invention has been described in detail and with reference to specific embodiments thereof, it will be apparent to one skilled in the art that various changes and modifications can be made therein without departing from the spirit and scope thereof.

What is claimed is:

1. A belt having a strap and a reversible belt buckle, the strap having a first end and a second end, the second end having a plurality of holes, the strap further having a top surface and a back surface, the buckle comprising:

(a) an inner frame member having a first end and a second end, a front side and a rear side, the first end having a slot to receive the first end of the strap, the second end having a first hinge section;

(b) a top member having a front surface, a rear surface, a first edge, a second edge, and a central axis, the rear surface having second hinge section disposed at the central axis, the top member having a pin disposed on the second hinge section perpendicular to a plane of the top member at the central axis;

(c) wherein, the first hinge section mates with the second hinge section to form a hinge point, wherein the top member is rotatable about the hinge point from a first position wherein the rear surface of the top member at the first edge faces the front side of the inner frame member, to a second position wherein the rear surface of the top member at the second edge faces the rear side of the inner frame member;

(d) wherein the top member covers the entire inner frame member when viewing the front surface of the top member when the top member is in the first position or the second position;

(e) a keeper disposed on the inner frame member of the buckle to secure the strap against the buckle, wherein the keeper forms an aperture for receipt of the strap, wherein the keeper is slidable from a first position wherein, when the top member is in the first position, the aperture is disposed on the rear side of the inner frame member, and when the top member is in the second position, the aperture is disposed on the front side of the inner frame member;

whereby, when the top member is in the first position, the top surface of the strap is exposed, and when the top member is in the second position, the back surface of the strap is exposed.

2. The belt having a strap and reversible belt buckle of claim 1, wherein, when the top member is in the first position, the rear surface of the top member urges the keeper to its first position, and when the top member is in the second position, the rear surface of the top member urges the keeper to its second position.

* * * * *